United States Patent [19]

Pasternack

[11] Patent Number: 5,076,267

[45] Date of Patent: Dec. 31, 1991

[54] CLOSED CIRCUIT BREATHING DEVICE WITH PRESSURE SENSING MEANS

[75] Inventor: Adalbert Pasternack, Bad Schwartau, Fed. Rep. of Germany

[73] Assignee: Drägerwerk Aktiengesellschaft, Lübeck, Fed. Rep. of Germany

[21] Appl. No.: 370,735

[22] Filed: Jun. 22, 1989

Related U.S. Application Data

[63] Continuation-in-part of Ser. No. 236,556, Aug. 25, 1988, abandoned.

[30] Foreign Application Priority Data

Nov. 3, 1987 [DE] Fed. Rep. of Germany ..... 3737182
Jul. 9, 1988 [DE] Fed. Rep. of Germany ..... 3823381

[51] Int. Cl.[5] ..... A62B 7/04; A62B 9/00; A61M 16/00

[52] U.S. Cl. ..... 128/205.22; 128/204.26; 128/205.13; 128/205.16; 128/205.24

[58] Field of Search ..... 128/204.18, 204.21, 128/204.22, 204.28, 205.12, 205.13, 205.14, 205.22, 204.26, 205.16, 205.24

[56] References Cited

U.S. PATENT DOCUMENTS

| | | | |
|---|---|---|---|
| 1,176,711 | 3/1916 | Gibbs | 128/204.28 |
| 2,830,583 | 4/1958 | Finney, Jr. | 128/204.21 |
| 3,033,195 | 5/1962 | Gilroy et al. | 128/204.21 |
| 3,046,979 | 7/1962 | Andreasen | 128/204.28 |
| 3,101,708 | 8/1963 | Perry et al. | 128/204.21 |
| 3,200,816 | 8/1965 | Bartlett, Jr. | 128/204.21 |
| 3,316,905 | 5/1967 | Seeler | 128/204.28 |
| 3,366,108 | 1/1968 | Blackburn et al. | 128/205.13 |
| 4,336,590 | 6/1982 | Jacq et al. | 128/204.22 |
| 4,423,723 | 1/1984 | Winkler et al. | 128/202.22 |
| 4,440,166 | 4/1984 | Winkler et al. | 128/204.22 |
| 4,498,470 | 2/1985 | Warncke | 128/202.26 |
| 4,567,889 | 2/1986 | Lehmann | 128/204.28 |
| 4,579,115 | 4/1986 | Wallroth et al. | 128/204.21 |
| 4,637,385 | 1/1987 | Rusz | 128/204.21 |
| 4,667,669 | 5/1987 | Pasternack | 128/204.23 |
| 4,938,212 | 7/1990 | Snook et al. | 128/204.26 |

FOREIGN PATENT DOCUMENTS

| | | | |
|---|---|---|---|
| 1336301 | 7/1963 | France | 128/205.12 |
| 1538953 | 9/1968 | France | 128/204.28 |

*Primary Examiner*—Edgar S. Burr
*Assistant Examiner*—Kimberly L. Asher
*Attorney, Agent, or Firm*—McGlew & Tuttle

[57] ABSTRACT

A circulation respirator is capable of excess-pressure operation with a compressed gas source and an auxiliary pressure arrangement which brings about an increase in the pressure in the respiratory circulation. The apparatus includes measuring circuit connected to a pressure sensor for controlling the auxiliary pressure arrangement. Excess pressure is maintained in the respiratory circulation independently of the respiratory phase. The sensor is arranged as pressure sensor in the respiratory circulation only if the pressure falls below a preset positive nominal value of the pressure in the respiratory circulation. A method of operating a respirator system which includes a respirator bag connected through an inhalation duct to a patients respirator gas connector to the respirator bag comprising sensing the pressure in a pressurized respiratory gas connection to the inhalation duct, and connecting an additional pressurized gas to the inhalation duct when the pressure in the said gas connection falls below a predetermined pressure.

12 Claims, 3 Drawing Sheets

CLOSED CIRCUIT BREATHING DEVICE WITH PRESSURE SENSING MEANS

RELATED CASE INFORMATION

This is a continuation-in-part application of application Ser. No. 236,556, filed Aug. 25, 1988, now abandoned.

FIELD AND BACKGROUND OF THE INVENTION

The invention relates, in general, to respirators and in particular to a new and useful circulation respirator for excess-pressure operation with a compressed gas source. The compressed gas source feeds an auxiliary arrangement which gives rise to a pressure increase in the respiratory circulation and also gives rise to a pressure increase in a measuring circuit connected to a sensor and controlling the auxiliary arrangement.

A similar circulation respirator is shown in DE 34 29 345 A1. In German reference DE 34 29 345 A1, a sensor connected to a measuring circuit monitors the fill level of the respiratory bag and is said to differentiate thereby between the inhalation phase and exhalation phase. The auxiliary arrangement is a cylinder-piston unit which is actuated by the compressed gas source. The auxiliary arrangement compresses the respiratory bag only during the inhalation phase and generates respiratory circulation excess pressure, which decreases in the exhalation phase. Consequently, during the exhalation phase no counter pressure is present, such a counter pressure places an additional unfavorable load on exhalation. In this prior known circulation respirator, however, it is desirable not to maintain the excess pressure during the entire inhalation phase because this represents unnecessary expenditures of energy for the fulfillment of the required functions. Moreover, determining the inhalation phase with the sensor coupled to the respiratory bag motion and scanning the position of the piston in the auxiliary device is difficult, and, in particular, no assurance is given that in the respiratory gas connection a positive pressure always obtains.

SUMMARY OF THE INVENTION

The invention provides a method and apparatus or equipment which regulates the excess pressure in the respiratory circulation independently of the respiratory phase and it includes an auxiliary arrangement for providing excess pressure which acts only if the pressure conditions in the respiratory circulation require it.

According to the invention a sensor is arranged acting as a pressure sensor in the respiratory circulation. A measuring circuit connected to the sensor triggers an auxiliary arrangement for increasing the pressure in the respiratory circulation only if a preset positive nominal value of the pressure in the respiratory circulation is not reached. The additional energy expenditure for operating the auxiliary arrangement is only required if the pressure in the respiratory circulation falls below a preset positive nominal value, for example below 0.1 mbar. This arrangement is specifically independent of whether or not the inhalation or exhalation phase is occurring.

Switching on the auxiliary arrangement, for increasing the pressure in the respiratory circulation, can prove to be inadvisable if a leak occurs in the respiratory circulation which cannot be eliminated. Respiratory air could escape, from such a leak, at an accelerated rate due to the effect of the auxiliary arrangement. This would lead to a rapid loss of oxygen in the case of circulation respirators with an oxygen bottle as compressed gas source. In such a situation the person using the device would be endangered if the oxygen supply would no longer be sufficient for the return.

In a further development of the invention it can therefore be provided that the measuring circuit is laid out so that it switches off the auxiliary arrangement if a preset danger value of the pressure below the nominal pressure occurs. Thereby the additional pressure increase is omitted and utilization of the available respiratory gas reserves is improved. Switching off can also be done manually by setting the nominal value to atmospheric pressure.

In a further development of the invention, it can be provided that the measuring circuit drives the auxiliary device for respiratory support in the inhalation and exhalation part of the respiratory cycle. Thereby both the inhalation and also the exhalation for the person using the device is made easier and his respiratory work is reduced. The auxiliary device therefore, functions in such a way that it reduces the compressible respiratory gas volume during the inhalation phase and increases it during the exhalation phase. Through the entire respiratory cycle support of the respiratory process, thereby, takes place and the person using the device achieves longer working periods without exhaustion.

In a preferred embodiment, the pressure sensor can be arranged in the respiratory gas connection of the device. Here, the respiratory gas connection is defined as the filling space connected with the mouth piece of the mask behind the inhalation valve and before the exhalation valve.

The sensor can also be formed in other ways. For example as an expansion sensor monitoring thorax expansion, at least one expansion measuring strip can be attached on a holding part to be fastened at the upper body in the form of a bodice.

The auxiliary arrangement for increasing the pressure in the respiratory circulation can be formed in a different manner, for example, as a solenoid valve controlled by the pressure in the respiratory circulation in connection with the compressed gas source. In this case, compressed gas, from the compressed gas source, is introduced into the respiratory circulation while circumventing the pressure reducer. Another possible advantageous technical solution builds on a known arrangement, in which the auxiliary arrangement is designed to compress the respiratory bag.

The compressible respiratory gas supply can usefully be formed in a respirator bag. This consists of a bellows which is bounded by a movable rigid front wall. The auxiliary device connected to this device can be a single-acting cylinder-piston unit which is pressurizable on at least one side through at least one compressed gas duct, with at least one switch valve being located in the compressed gas duct. The switch valve in accordance with the control by the measuring circuit, connects at least one cylinder chamber to the compressed gas duct.

If support of breathing is needed in the inhalation phase and exhalation phase, two cylinder chambers of a double-acting cylinder-piston unit can be connected to compressed gas ducts via the switch valves, driven alternately by the measuring circuit. Thereby, the respirator bag is compressed in the inhalation phase and expanded in the exhalation phase. However, the respiration takes place with assurance given that the pressure in the respiratory circulation remains above a preset positive nominal value.

In a further embodiment, the switch valve is so connected that upon exceeding the preset positive nominal value in the cylinder chamber, the connection with the compressed gas duct is blocked and the cylinder chamber is connected to a ventilation duct. This ventilation duct is connected to the interior of the respirator bag to avoid loss of respiratory gas.

An alternative formation of the single-acting auxiliary device consists in forming the device as a control valve connected to the compressed gas source which injects the compressed gas into the respiratory circulation depending on the control by the measuring circuit. The measuring circuit provides the control if the pressure falls below positive nominal value, thereby circumventing an available pressure reducer for direct feeding.

In a useful embodiment the auxiliary arrangement is a cylinder-piston unit pressurizable via a compressed gas duct from the compressed gas source. A change-over valve is located in the compressed gas duct which, in accordance with the control by the measuring circuit, upon falling below the preset positive nominal value, connects the cylinder space of the cylinder-piston unit to the compressed gas duct, and connects, outside of this operating state, the cylinder space with the ventilation duct while blocking the compressed gas duct. Ventilation of the cylinder space, usefully takes place via a connecting duct with the interior of the respiratory bag, so that the respiratory gas used for activating the auxiliary arrangement can be utilized for respiration.

Accordingly it is an object of the invention to provide a method of operating a respirator which includes a respirator bag connected through an inhalation duct to a patient's respirator gas circulation connection, an exhalation duct extending from the gas connection to the respirator bag, and which includes a pressurized respiratory gas connection to the inhalation duct; and which comprises, sensing the pressure in the gas connection, and connecting the additional pressurized respiratory gas connection to the inhalation duct when a pressure in the gas connection falls below a predetermined pressure.

A further object of the invention is to provide an apparatus which includes a circulation respirator for excess pressure operation having a user's respirator gas connection for respiration gas circulation. An inhalation duct and an exhalation duct is connected to a compressed gas source for feeding a pressurized gas to the inhalation duct which also includes an auxiliary pressure arrangement. The auxiliary pressure arrangement brings about a pressure increase in the respiratory circulation. The respiratory circulation is connected to the inhalation duct. A sensor is connected to the inhalation duct and is part of a measuring circuit connected to the sensor which acts as a pressure sensor for controlling the auxiliary pressure arrangement. The auxiliary pressure arrangement increases the pressure in the respiratory circulation only if the pressure falls below a preset positive nominal value of pressure.

A further object of the invention is to provide a respirator circulation system which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
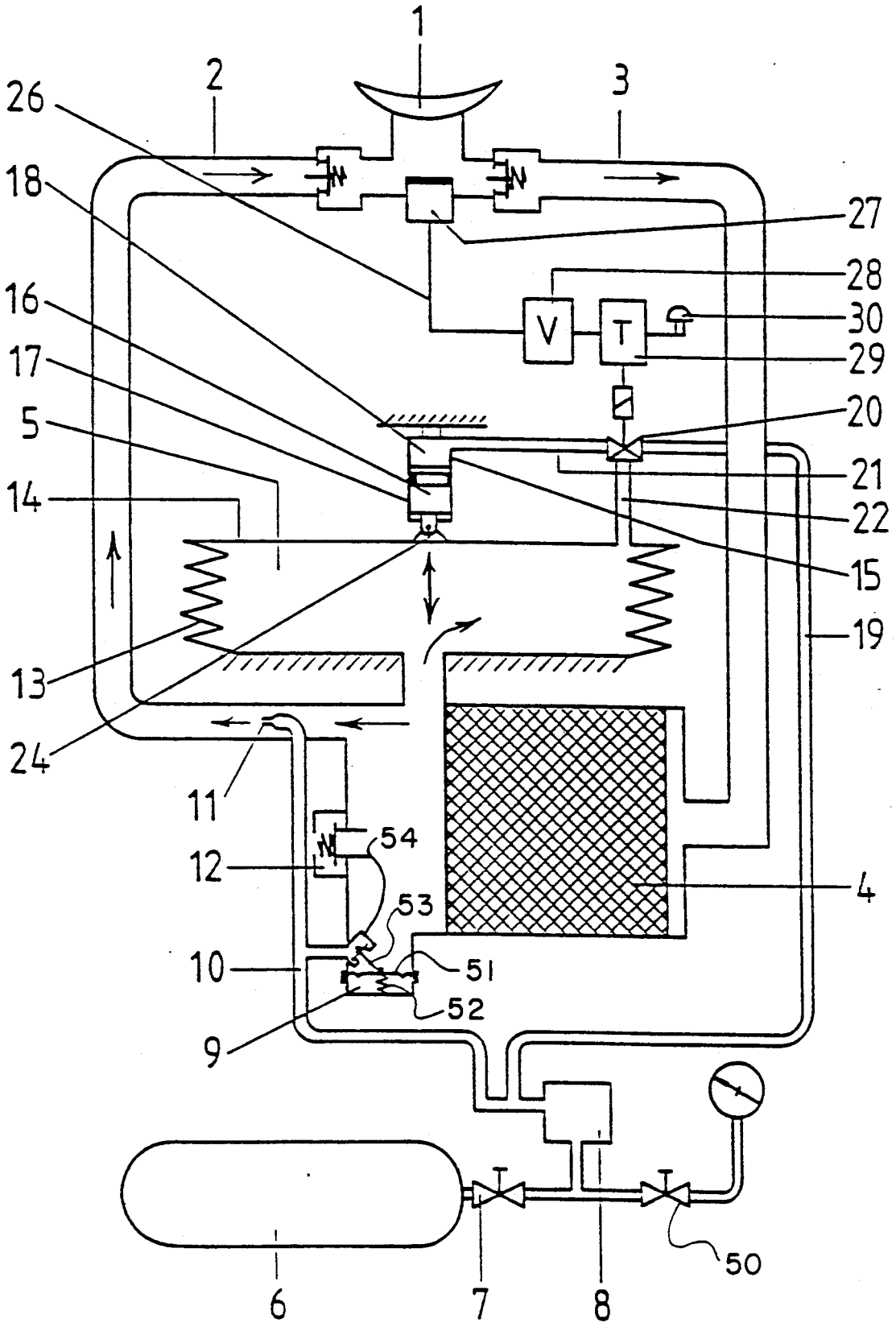
FIG. 1 is a schematic diagram showing the arrangement of a circulation respirator having a separate pressurizing arrangement for the respiratory gases.

Referring to the drawings, in particular, in accordance with the method of the invention, the respirator system is operated so that inhalation gases pass through an inhalation duct 2 from a breathing bag 5 through a patient's respiratory gas connection 1. The gases flow out through an exhalation duct 3 back to the breathing bag 5 after passing through a regenerating cartridge 4. In accordance with the invention there is a auxiliary pressure arrangement generally designated 15 for increasing the pressure in the respiratory circulation system, and which is connected also to a compressed gas duct 19. A supply of breathing or respiratory gases, such as oxygen, is supplied from an oxygen tank 6 under pressure. In accordance with a feature of the invention, additional pressurized gases are supplied to the inhalation duct 2 from the auxiliary arrangement 15 for augmenting gas pressure.

The circulation respirator shown in FIG. 1 with excess-pressure operation contains the structural parts represented in functional configuration and forming the respiratory circulation on a carrier frame with an outer protective cover. The respirator system includes the respiratory gas connection 1, the exhalation duct 3, the regeneration cartridge 4 which binds the carbon dioxide present in the exhalation air, the breathing bag or respiratory bag 5, and the inhalation duct 2. The oxygen used in respiration is supplied as a compressed gas source from the cylindrical steel oxygen tank 6 to a valve 7. The gas passes through a pressure reducer 8 and a lung motor 9. The lung motor 9, as shown in FIG. 1, consists of a spring 52, a diaphragm 51, a valve 54, and a connecting rod 53. The connecting rod 53 connects the valve 54 with the diaphragm 51. Low pressure in the respiratory circulation moves diaphragm 51 which then moves connecting rod 53 opening valve 54 in a known manner. The gas passes via a pipe duct 10 with a constant apportioning arrangement 11 to the respiratory circulation behind the respiratory bag 5. An excess pressure valve 12 behind the regeneration cartridge 4 prevents impermissible high pressure in the respiratory circulation.

The respiratory bag 5 comprises a bellows 13, which is closed by a front face 14 rigid as to movement. The auxiliary arrangement for increasing pressure in the respiratory circulation comprises a cylinder-piston unit 15 with a piston 16 and a cylinder 17. The cylinder 17 is open on one side and the displaceable piston is connected with the rigid front face 14 by a connection.

Above the piston 16 is located a cylinder space 18 which is connected via a pressure duct 19 to the pipe duct 10.

The pressure duct 19 contains a solenoid valve 20 which acts as a changeover valve to close the pressure duct 19, and subsequently the cylinder space 18 can be connected by the duct part 21 to a connecting, ventilation duct 22 of the respiratory bag 5.

The control of the cylinder-piston unit 15 takes place through a measuring circuit comprising an amplifier 28 and a transmitter 29 and connected to an indicator device 30 for switching on the auxiliary arrangement. The measuring circuit is connected through a connecting duct 26 with a pressure sensor 27 arranged in the respiratory gas connection 1.

If pressure sensor 27 measures a positive nominal value at the respiratory gas connection 1 (i.e. a respiratory pressure is measured >0 and above the preset nominal value), then the auxiliary arrangement 15 remains switched off. If independently of the respiratory phase the nominal value, for example 0.1 mbar, is not reached (this occurs generally only in the area of the inhalation phase) the solenoid valve 20 is opened via amplifier 28 and transmitter 29, so that respiratory gas from the respiratory gas source 6 drives, via the compressed gas duct 19, the piston 16 forward, which through its connection 24 with the front face 14, moves the front face downward and thereby compresses the respiratory bag 5.

If the pressure in the respiratory circulation increases, the pressure sensor 27 determines that the nominal value has been exceeded and resets the solenoid valve 20 via the transmitter 29 in such a way that the compressed gas duct 19 is blocked and the cylinder space 18 is ventilated through connection via duct part 21 and connecting, ventilation duct 22 to the respiratory bag 5.

The pressure surveillance with the aid of the pressure sensor 27 at the respiratory gas connection 1 ensures that in no phase of the respiration a negative pressure occurs at the respiratory gas connection 1.

Figure 2:
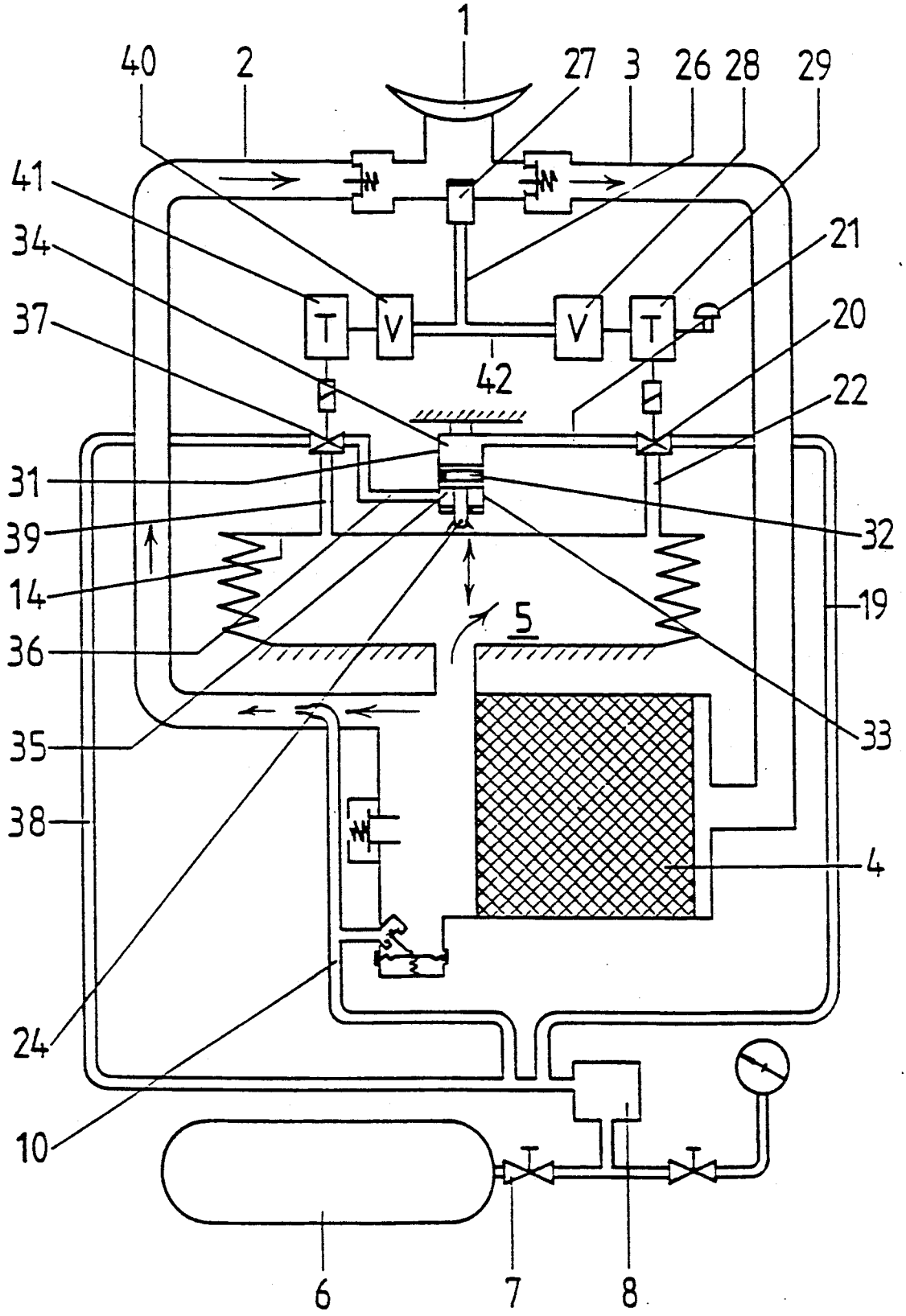
FIG. 2 is a schematic diagram showing the arrangement of a circulation respirator having a double-acting separate pressurizing arrangement for the respirator gases, and, FIG. 3 is a schematic diagram showing a segment from FIG. 1 and FIG. 2 with an alternate pressure sensor.

In the embodiment shown in FIG. 2 an auxiliary device is used which is formed as double-acting cylinder-piston unit 31. This cylinder-piston unit 31 contains a piston 32 with an upper cylinder chamber 34 and a lower cylinder chamber 35 being formed in the cylinder 33. The upper cylinder chamber is connected by way of a duct part 21 with the solenoid valve 20 which optionally establishes a connection between the duct part 21 and the compressed gas duct 19 or between the duct part 21 and the connecting, ventilation duct 22.

Similarly, the lower cylinder chamber 35 is connected through a duct piece 36 with a further solenoid switch or changeover valve 37 which connects the duct piece 36 optionally to an additional compressed gas duct 38 or to a further connecting, ventilation duct 39 emptying into the respirator bag 5.

The measuring circuit consists in this case likewise of an amplifier 28 and the transmitter 29 for driving the solenoid valve 20 and of a further amplifier 40 in connection with an additional transmitter 41 for controlling an additional solenoid valve 37. Both amplifiers 28 and 40 are connected in addition to the connecting duct 42 and than to the further connecting duct 26 to the pressure sensor 27.

The measuring circuit is so designed that the amplifier 28 is driven in any case if the pressure in the respiratory circulation falls below the preset positive nominal value during the inhalation, or the exhalation phase. The amplifier 40, in contrast, is driven only in the exhalation phase. During the inhalation phase the solenoid valve 20 is so driven that compressed gas flows from the compressed gas duct 19 through duct part 21 into the upper cylinder chamber 34 of the cylinder-piston unit 31. Through the articulation 24 with the rigid front wall 14 of the respirator bag 5 the respirator bag 5 is compressed upon the downward motion of piston 32 reducing the volume thereof. In this operating position, the additional solenoid valve 37 is driven in such a way that a connection between the duct piece 36 and the additional ventilation duct 39 exists whereby the lower cylinder chamber 35 is connected with the interior of the respirator bag 5.

In the exhalation phase, the solenoid valves 20 and 37 are switched. Thereby, the upper cylinder chamber 34 is connected through the duct part 21 and the connecting, ventilation duct 22 with the interior of the respirator bag 5. Simultaneously, compressed air flows through the compressed gas duct 38 through the duct piece 36 into the lower cylinder chamber 35 and moves the piston 32 upward. The front wall 14 of the respirator bag 5 connected to the piston 32 is raised. This increases the volume of the respirator bag 5 and increasing the volume thereof thereby a pressure reduction is brought about in the respirator bag 5 which supports the exhalation process.

The remaining parts of the embodiment in FIG. 2 are not further discussed but correspond to the embodiment according to FIG. 1.

Figure 3:
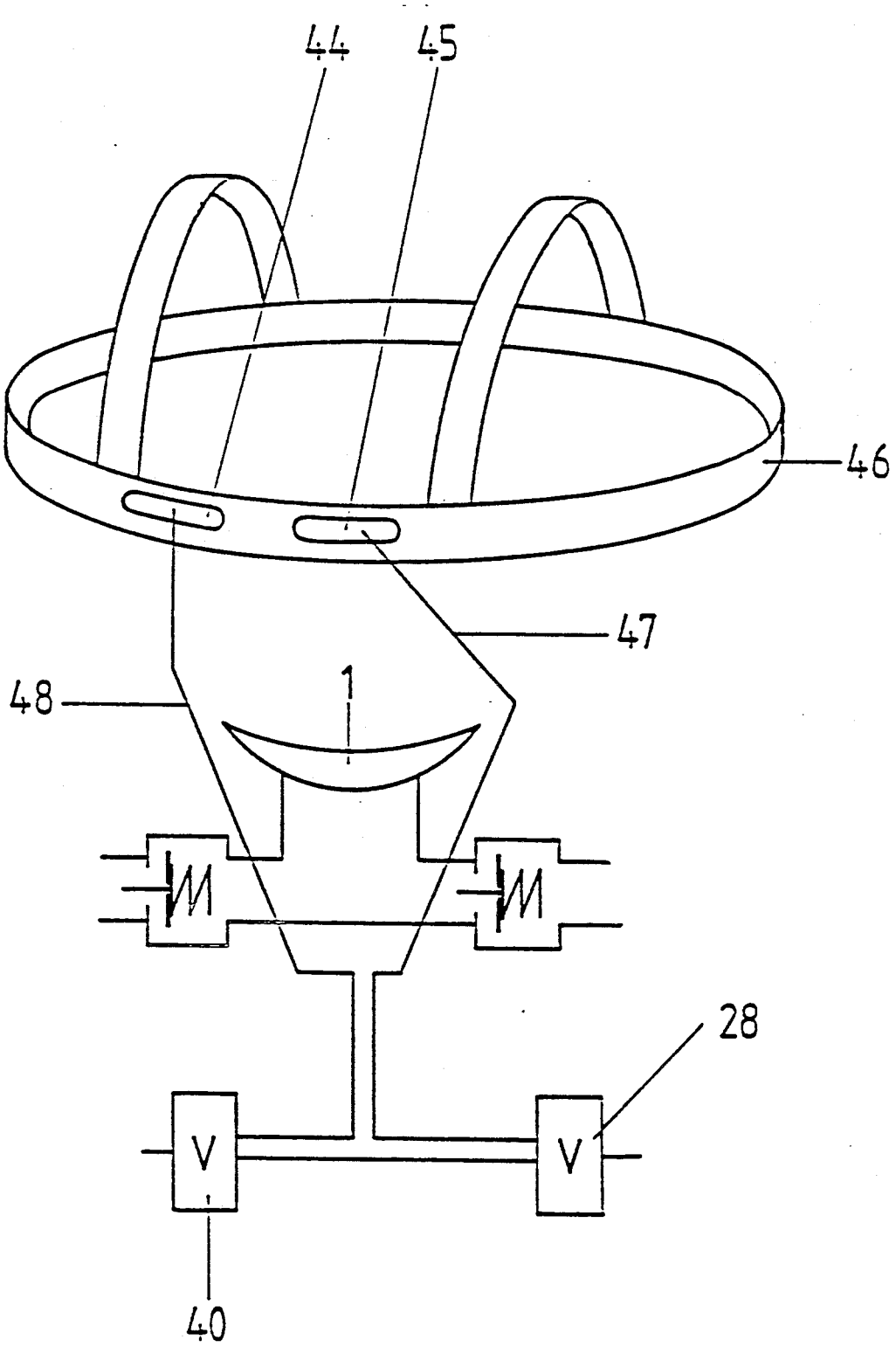

Lastly, FIG. 3 shows the replacement of the pressure sensor 27 in the respiratory circulation by two successive expansion measuring strips 44 and 45 which are arranged on a holding part 46 to be worn on the chest. The output of the expansion measuring strips 44 and 45 is connected via connecting lines 47 and 48 with the amplifiers 28 and 40. The remaining parts of the circulation respirator arranged as in FIG. 2 have been omitted for the sake of clarity.

A valve 5031, which, in the original arrangement is manually operated, is upstream of a pressure meter for determining the pressure in the oxygen bottle 6. The valve 5031 is formed as a solenoid valve and is connected via a control duct with the transmitter 29 of the measuring circuit. If the pressure decreases independently of the respiratory phase below the preset nominal value, then a command is issued via the transmitter 29 to open the solenoid valve 31, so 50 that for increasing the pressure, circumventing the pressure reducer 8, oxygen flows from the oxygen bottle 6 through a connecting duct into the respiratory circulation.

While specific embodiments of the invention have been shown and described in detail to illustrate the application of the principles of the invention, it will be understood that the invention may be embodied otherwise without departing from such principles.

What is claimed is:

1. A circulation respirator, comprising:

a user's respiratory gas connection for establishing a respiratory circulation having an inhalation duct and an exhalation duct;

a compressed gas source connected to said inhalation duct;

a compressible respiratory gas reserve connected to each of said inhalation and exhalation ducts, said compressible respiratory gas reserve is formed in a respirator bag;

auxiliary pressure means connected to said compressible respiratory gas reserve for increasing the gas pressure in the respiratory circulation, said auxiliary pressure means includes a cylinder-piston unit with first and second pressurizable cylinder chambers each being connected to a compressed gas duct via a first and second switch valve, respectively, said cylinder-piston unit acting on said respirator bag to alter the respiratory circulation gas pressure;

pressure sensor means for sensing the respiratory circulation gas pressure; and, measuring circuit means connected to said switch valves to alternately open said first and second switch valve for, independently of the users respiratory cycle, controlling the operation of said auxiliary pressure means to activate said auxiliary pressure means when the respiratory circulation gas pressure falls below a preset position nominal pressure value.

2. A circulation respirator according to claim 1, wherein said measuring circuit means further operates to shut off said auxiliary pressure means if the respiratory circulation gas pressure falls below the preset nominal pressure value by more than a preset danger value.

3. A circulation respirator according to claim 1, wherein said measuring circuit means drives the auxiliary pressure means including means for supporting respiration during the inhalation and exhalation part of the respiratory cycle.

4. A circulation respirator according to claim 3, wherein the auxiliary pressure means includes means for decreasing the volume of the compressible respiratory gas reserve in the inhalation phase and increasing the volume of the compressible respiratory gas reserve during the exhalation phase.

5. A respirator according to claim 4, wherein said pressure sensor means includes a means to monitor the expansion of the user's thorax.

6. A respirator according to claim 5 wherein said means to monitor the expansion of the user's thorax has at least one expansion strip on a holding part to be fastened on the upper body.

7. A respirator according to claim 6, wherein said holding part is formed in the form of a bodice.

8. A circulation respirator according to claim 1 wherein said pressure sensor means is located in the respiratory gas connection.

9. A circulation respirator according to claim 1 wherein said compressible respiratory gas reserve is formed in respirator bag said auxiliary pressure means being connected to compress the respirator bag for increasing the gas pressure.

10. A circulation respirator according to claim 1 wherein said first switch valve includes means for disconnecting said first cylinder chamber from said compressed gas duct and connecting said first cylinder chamber to a ventilation duct upon a preset positive nominal value being exceeded.

11. A circulation respirator according to claim 10, wherein said ventilation duct is connected to the interior of the respirator bag.

12. A circulation respirator according to claim 1 wherein the auxiliary pressure means is a control valve connected to the compressed source, said compressed gas source being connected to a pressure reducer and being connected to a bi-pass, said control valve circumventing said pressure reducer and allowing compressed gas to flow through said bi-pass to the respiratory circulation if the respiratory circulation gas pressure has fallen below a preset positive nominal pressure valve.

* * * * *